United States Patent [19]

Daw et al.

[11] Patent Number: 4,470,525

[45] Date of Patent: Sep. 11, 1984

[54] COAL STORAGE HOPPER WITH VIBRATING SCREEN AGITATOR

[75] Inventors: Charles S. Daw, Knoxville; Mack E. Lackey, Oak Ridge; Ronald L. Sy, Clinton, all of Tenn.

[73] Assignee: The United States of America as represented by the United States Department of Energy, Washington, D.C.

[21] Appl. No.: 372,348

[22] Filed: Apr. 27, 1982

[51] Int. Cl.[3] ..... B65D 88/66

[52] U.S. Cl. ..... 222/200; 222/227

[58] Field of Search ..... 222/198, 199, 200, 189, 222/227, 232, 233, 234, 244

[56] References Cited

U.S. PATENT DOCUMENTS

| | | | |
|---|---|---|---|
| 766,407 | 8/1904 | Wolfe | 222/199 X |
| 3,414,168 | 12/1968 | Eckhardt | 222/413 X |
| 4,285,447 | 8/1981 | Fairbank | 222/200 |
| 4,346,802 | 8/1982 | Popper | 222/200 X |

FOREIGN PATENT DOCUMENTS

| | | | |
|---|---|---|---|
| 1279546 | 10/1968 | Fed. Rep. of Germany | 222/200 |

*Primary Examiner*—F. J. Bartuska

*Attorney, Agent, or Firm*—Earl L. Larcher; Stephen D. Hamel; Michael F. Esposito

[57] ABSTRACT

The present invention is directed to a vibrating screen agitator in a coal storage hopper for assuring the uniform feed of coal having sufficient moisture content to effect agglomeration and bridging thereof in the coal hopper from the latter onto a conveyor mechanism. The vibrating screen agitator is provided by a plurality of transversely oriented and vertically spaced apart screens in the storage hopper with a plurality of vertically oriented rods attached to the screens. The rods are vibrated to effect the vibration of the screens and the breaking up of agglomerates in the coal which might impede the uniform flow of the coal from the hopper onto a conveyer.

2 Claims, 1 Drawing Figure

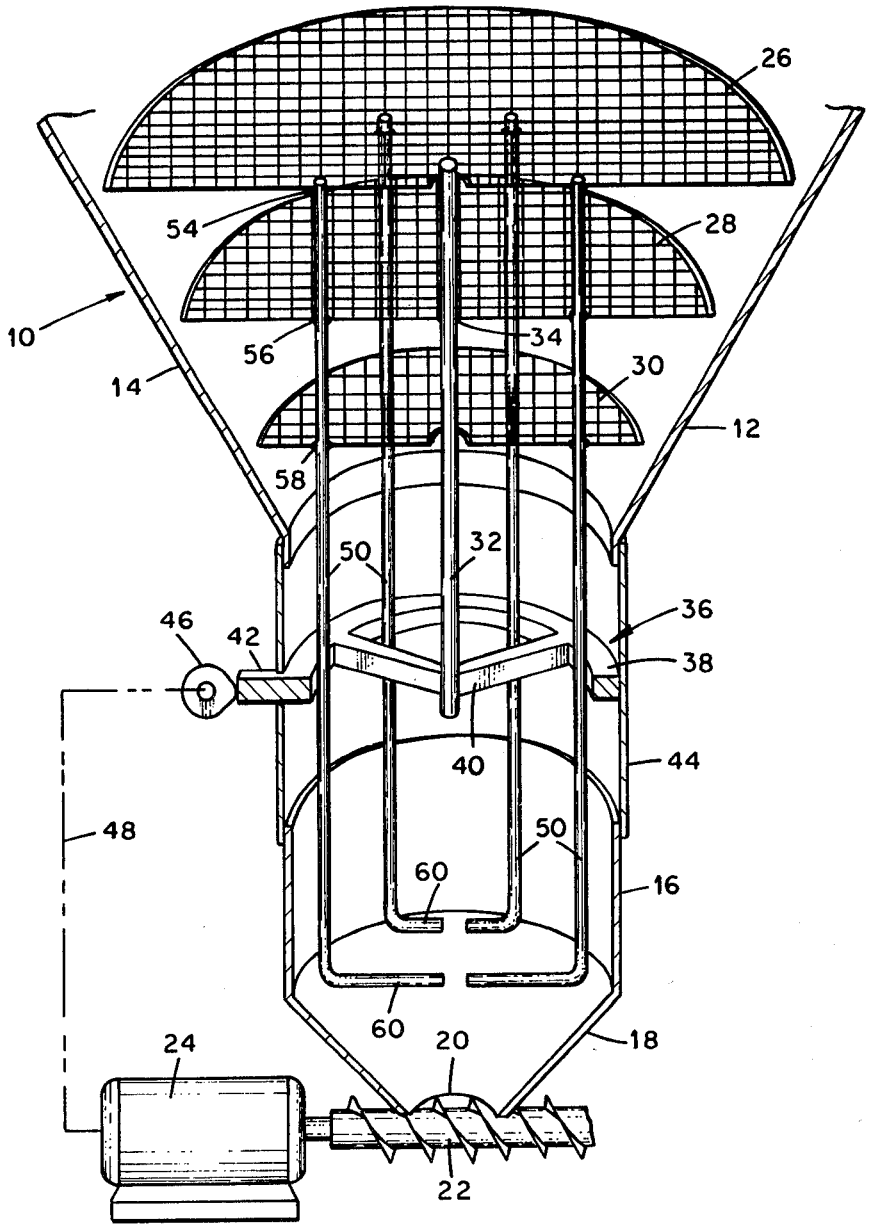
26
54
28
10
56
34
30
14
12
58
50
32
36
46
42
38
40
44
48
50
60
16
60
20
18
24
22

COAL STORAGE HOPPER WITH VIBRATING SCREEN AGITATOR

BACKGROUND OF THE INVENTION

The present invention is directed generally to a coal storage hopper for feeding coal into a conveying mechanism, and more particularly to an apparatus within a storage hopper for effectively and uniformly feeding moisture-bearing coal particles onto a conveying mechanism under the hopper. This invention was made as a result of a contract with the United States Department of Energy.

The coal feeding and distribution systems used for feeding particulate (finely crushed) coal into various combustion systems are becoming of increasing importance since the sophisticated combustors utilizing particulate coal require a uniform and continuous supply of crushed coal to maintain a desired level of combustion efficiency, effective sulfur capture, minimal tube corrosion, etc. Some problems attendant with the coal distribution systems have been found to be due to the presence of moisture in or on the surface of the coal particles. Crushed coal with up to about 5–6 wt.% surface moisture can be fed from most hopper systems onto a conveyer mechanism without encountering much difficulty. However, with surface moisture greater than about 6 wt.% plugging problems occur in the hopper due to the tendency of the coal to agglomerate and form bridges in the hopper which impair or reduce the efficiency of the coal feeding mechanism.

The utilization of standard hopper designs have not been found to be adequate for maintaining a uniform rate of coal flow with coal containing greater than about 6 wt.% moisture. Efforts to overcome this problem include drying the coal to less than 6 wt.% moisture prior to feeding the coal into the hopper. With the coal dried to less than 6 wt.% moisture content, the coal can be delivered from the hopper onto the conveying mechanism without any plugging problems. But drying the coal is considerably expensive and requires a relatively significant capital investment as well as continuous maintenance and operating costs. Various attempts to modify the hopper systems by changing the shape thereof or by adding a lubricant coating to the hopper, etc. have not significantly improved the feeding characteristics. Additional efforts included the use of push rods in the hopper for breaking up of the coal agglomerates and bridges. These efforts for improving coal feeding have not proved to be as successful as desired for effecting the required uniform feed of the coal from the hopper onto the conveying mechanism.

SUMMARY OF THE INVENTION

Accordingly, it is the primary aim or objective of the present invention to provide a coal storage hopper with a vibrating screen agitator for uniformly feeding coal having sufficient moisture content to effect the agglomeration and bridging thereof onto a conveyer system without encountering such agglomeration and bridging. Generally, the present invention comprises a storage hopper arranged to deliver the particulate coal onto a conveyer means underlying the hopper. The storage hopper comprises a vertically oriented housing with screen means transversely disposed in the housing at vertically spaced apart locations, elongated means are vertically oriented in the housing and attached to the screen means for cantileveredly supporting the screen means in the housing. Means are in turn coupled to the elongated means for sufficiently vibrating the elongated means and the screen means attached thereto to assure gravity flow of the particulate material from the hopper onto the conveyer means. This vibration of the screen and the elongated means breaks up any agglomerates and bridges in the coal to assure that the coal will not bridge in the hopper so as to disrupt the uniform feeding of the coal from the hopper onto the conveyer means underlying the hopper.

Other and further objects of the invention will be obvious upon an understanding of the illustrative embodiment about to be described or will be indicated in the appended claims, and various advantages not referred to herein will occur to one skilled in the art upon employment of the invention in practice.

DETAILED DESCRIPTION OF THE DRAWING

The figure is a vertical sectional view of a coal storage hopper overlying a screw-type conveyer vdth the storage hopper incorporating the vibrating screens and rods utilized for inhibiting the formation of coal bridges within the hopper in accordance with the present invention.

A preferred embodiment of the invention has been chosen for the purposes of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

As shown in the accompanying drawing, the storage hopper arrangement of the present invention is generally shown at 10. The hopper comprises a vertically oriented housing 12 having an upper tapered or inverted cone-shaped wall portion 14. The angle of this taper may be at about 60° or any other desired angle. The wall portion 14 is coupled to a chute or duct 16 attached which is in turn coupled to a tapered section 18 underlying the duct 16. The angle of the tapered section 18 is preferably about 45 degrees. An opening 20 is at the base of the tapered section 18 and is utilized to feed the coal from the hopper housing 12 onto a screw-type conveyer 22. While the conveyer 22 is shown as a screw-type feeder it will be clear that any other suitable types of conveying mechanisms such as belts, air ducts, and the like may be utilized for delivering the coal from the storage hopper 10 to a suitable combustion system (not shown). The screw conveyer 22 is driven by a motor 24 which may also be used to drive the screen vibration system of the present invention as will be described in detail below.

Within the tapered wall portion 14 of the storage hopper housing 12 there is disposed three horizontally oriented discoidal screens 26, 28, and 30. While three screens are shown, any suitable number of screens may be used to practice the present invention. These screens are positioned at vertically spaced apart locations and are of diameters slightly less than the inner diameter of the tapered wall portion of the housing 14 that lies in a plane contiguous to the peripheral edge of each screen so as to be radially inwardly spaced from the walls of the housing 12. The openings provided through the screens are sufficiently large so as to allow for the flow of the coal particulates of the size utilized in the combustion system but are also small enough to provide a support for the coal so that any bridging or agglomeration of the coal particles occurring within a tapered wall portion 14 would occur on the screens. With the coal agglomerates being supported on the screens the vibration of the screens effectively breaks up the agglomerates to allow for the flow of the coal particulates through the openings in the screens.

A vertically oriented rod 32 is centrally disposed within the tapered wall portion 14 and extends through the radial center of the screens and into the duct 16. This vertically oriented rod is shown attached to the central screen 28 by a weld 34 or any other suitable attachment. The rod 32 is also shown spaced from the screens 26 and 30 so that radial movement of the rod 32 will not contact the screens 26 and 30. However, if desired, the rod 32 can also be attached to screens 26 and 30 without adversely affecting the vibration of all the screens. The rod 32 is, in turn, supported within the storage hopper 10 by a rod support bracket 36 which is transversely mounted in the duct 16 and is shown comprising an annular portion 38 having the outer periphery thereof bearing against and attached to the inner wall of the duct 16. A plurality of radially inwardly spaced arms 40 are attached to the annular portion 38 and terminate at the rod 32 where a suitable weld or the like is utilized to secure the rod 32 to the rod support arms 40. A flange or projection 42 on the rod projects through the wall of the duct 16 to a location external of the storage hopper.

The portion of the duct 16 contacted by the rod support bracket 36 is relatively flexible and is shown as an annulus 44 attached to the lower end of the tapered wall portion 14 and to the portion of the duct 16 above the tapered wall section 18. This flexible wall section 44 may be formed of any suitable relatively thin metal or bellows like material so that movement of the rod support bracket 36 may be readily achieved to radially displace and vibrate the vertically extending rod 32.

A cam or an eccentric 46 is shown engaging the flange 42 to effect horizontal movement of the rod support bracket 36 to vibrate the vertically oriented rod 32. This cam 46 is coupled to the motor 24 by a suitable drive mechanism 48 so as to effectively operate the screen vibrating mechanism during the operation of the motor 24. A suitable control may be utilized in this drive mechanism 48 to effect selective operation of the vibration mechanism within the storage hopper. Also, while not shown, the cam or eccentric 46 may be driven by any other suitable drive mechanism so as to provide for the selective operation of the screen vibration mechanism.

A plurality of vertically extending rods 50 are disposed in the hopper 10 and project from a location adjacent the lower tapered section 18 up through the screens 26, 28 and 30. These rods 50 are attached to the screens 26, 28 and 30 by welds shown at 54, 56, and 58 respectively for supporting the screens in horizontal planes. The rods 50 are disposed a radial array about the central rod 32 and may number as many as 8 to 12 rods. These rods 50 extend through the rod support bracket 36 at a location radially inwardly spaced from the annular portion 38 so as to be out of contact with the rod support bracket 36. The lower end of each of the rods 50 are bent at right angles in an inward direction to provide fingers 60 which terminate at various levels and locations within the lower end of the duct 16 above the tapered section 18. These fingers 60 aid in stirring the coal particulates in the lower end of the duct 16 above the lower tapered section 18 to help assure the flow of coal from the hopper 10 onto the conveyer means 22.

The central rod 32 and the surrounding rods 50 provide for the cantilever support of the screens 26, 28, and 30 within the storage hopper so that upon actuation of the cam 46, the vibration of the central rod 32 will vibrate the central screen 28 which in turn, effects movement of the rods 50 to effect the vibration of the screens 26 and 30 as well as the rods 50 and the fingers 60 at the lower end thereof.

When the coal containing about 6 wt.% or more surface moisture is introduced into the hopper 10, the vibration system is actuated to vibrate the screens 26, 28, and 30 and the rods 50 to effect disruption of any coal agglomeration and bridging within the storage hopper to assure the uniform feed of coal through the storage hopper onto the conveyer 22. Tests using this vibration screen mechanism vdth coal having a moisture of about 8 wt.% provided for uniform feeding of the coal through the hopper without disruption. This value of moisture content is that normally expected for coal exposed to weather immediately prior to use. No agglomeration or bridging occurred during the feeding of the coal.

It will be seen that the present invention provides a mechanism for assuring the flow of coal from a hopper onto a conveyer even though the coal contains sufficient moisture to effect agglomeration and bridging in conventional hopper systems. While the present invention is directed primarily to the feeding of coal particulates into a combustion system, it will appear clear that the hopper system of the present invention may be utilized for feeding any agglomeratable material onto a conveyer system in a highly uniform manner without encountering bridging problems such as those occurring with coal due to the presence of moisture or other agglomeration causing substance on the particulate feed material.

What is claimed is:

1. A storage hopper for delivering particulate material containing sufficient moisture to effect agglomeration thereof onto conveying means underlying the storage hopper, comprising, a vertically oriented housing having an inner wall defining an inwardly tapered portion, a plurality of horizontally oriented screens disposed in said tapered portion with said screens being vertically spaced apart from one another and said inner wall, a vertically oriented rod centrally disposed in said housing and attached to at least one of said screens for cantileveredly supporting the screens in said housing, a plurality of vertically oriented rods disposed in a radial array about the centrally disposed rod and attached to each of said screens for horizontally supporting said screens in said housing and for coupling said screens to the centrally disposed rod, a transversely oriented bracket carried by an annular section of said housing at a location underlying said tapered portion with said bracket having an annular portion and a plurality of radially inwardly spaced arms coupled to the centrally disposed rod, each of said plurality of rods having an end portion extending vertically through said bracket and terminating as projections disposed at right angles to said rods, and drive means coupled to the bracket for displacing the latter to effect movement of the centrally disposed rod and the vibration of the screens.

2. A storage hopper as claimed in claim 1 wherein the annular section of said housing underlying the tapered portion is relatively flexible with respect to the remainder of said housing, the annular portion of said bracket is attached to the flexible portion, and wherein the drive means moves the flexible portion and the bracket to effect the movement of the centrally disposed rod and the vibration of said screens and said end portion of each of said plurality of rods.

* * * * *